US005776008A

United States Patent [19]

Lundberg

[11] Patent Number: 5,776,008

[45] Date of Patent: Jul. 7, 1998

[54] COMPOSITE GOLF CLUB SHAFT HAVING LOW MOMENT OF INERTIA

[76] Inventor: Harry C. Lundberg, 312 Shadyside Rd., Ramsey, N.J. 07446

[21] Appl. No.: 774,466

[22] Filed: Dec. 30, 1996

[51] Int. Cl.[6] ..... A63B 53/10; A63B 53/12

[52] U.S. Cl. ..... 473/320; 273/DIG. 23

[58] Field of Search ..... 473/316–323, 473/7; 273/DIG. 7, DIG. 23

[56] References Cited

U.S. PATENT DOCUMENTS

| | | | |
|---|---|---|---|
| 2,037,636 | 4/1936 | Lagerblade | 473/323 |
| 3,691,000 | 9/1972 | Kalnin | 273/DIG. 7 |
| 4,000,896 | 1/1977 | Lauraitis | 473/319 |
| 4,169,595 | 10/1979 | Kaugars | 473/323 |
| 4,319,750 | 3/1982 | Roy | 319/320 |
| 5,294,119 | 3/1994 | Vincent | 473/318 |
| 5,465,967 | 11/1995 | Boeckenhaupt | 473/297 |
| 5,599,242 | 2/1997 | Solviche | 473/319 |
| 5,632,691 | 5/1997 | Hannon | 473/297 |

*Primary Examiner*—Sebastiano Passaniti
*Assistant Examiner*—Stephen L. Blau
*Attorney, Agent, or Firm*—John H. Crozier

[57] ABSTRACT

In a preferred embodiment, a shaft for a golf club, the shaft including: tip and butt ends defined at opposite distal ends of the shaft's length; and the shaft having a balance point axially spaced from the tip end a distance in the range of from about 56 percent to about 58.5 percent of the shaft's length. In another preferred embodiment, there is provided a composite shaft for a golf club, the shaft including: tip and butt ends defined at opposite distal ends of the shaft's length; the shaft being tubular and tapering generally from a larger diameter at the butt end to a smaller diameter at the tip end; the shaft being constructed primarily of a first material having a first modulus of elasticity; and two, spaced apart cylinders of a second, reinforcing material, having a second modulus of elasticity greater than the first modulus of elasticity, disposed axially in the first material, the cylinders being disposed either side of a point axially spaced from the tip end a distance in the range of from about 45 percent to about 52 percent of the shaft's length.

7 Claims, 9 Drawing Sheets

COMPOSITE GOLF CLUB SHAFT HAVING LOW MOMENT OF INERTIA

BACKGROUND OF THE INVENTION

1. Field of the Invention

The present invention relates to golf club shafts generally and, more particularly, but not by way of limitation, to composite graphite golf club shafts having low moments of inertia, for use on woods and irons, with a predetermined set of zones of flexure to control the club head orientation, to provide increased club head velocity at impact with the ball.

2. Background Art

As a game, golf has been played for centuries. Since it is evidently difficult to master, much thought and effort has been put into designs and redesigns to find clubs that are game improvers and easier to use. Recently, composite-graphite shafts have steadily grown in popularity and professionals are using them in some or all of the clubs of their sets.

In FIG. 1, there is shown an example of the most common type of composite graphite golf club shaft design in use. The net weight of these common design shafts is substantially lower than steel shafts, in some cases up to 50 grams less. For those who played and practiced a great deal, it was found that the vibratory dampening effect of graphite shafts, as compared to steel shafts, reduced muscle soreness. Manufacturers found that the shaft weight reduction enabled them to increase head weights. When done properly, so the effective mass at collision with the ball was increased, it can be said that many players experienced a gain in distance of their shots. These shafts have generally been made in 45" lengths for "wood" clubs and 39" lengths for "iron" clubs. Until recently, a standard driver was made at 43" long; the #3 fairway wood at 42"; the #5 wood at 41", etc. The irons were made in one half increments of length with the #9 iron at 35.5"; the #8 at 36"; the #7 at 36.5", etc.

It was also found that clubs could be made longer and still be swung with reasonable effectiveness by the majority of players. There are now many woods available up to 1 inch, and more, longer than previously; and irons 0.5" longer, and more. In time, lighter and lighter shafts have been developed by substituting high and ultra-high modulus-of-elasticity materials for the more bulky low modulus materials. All of this has also led to a gain in distance by many players. Taken in total, the popularity of graphite shafts is not surprising.

Claims have been made that lighter shafts produce greater swing speeds. This is simplistic, of course, and ignores moment of inertia considerations.

FIGS. 2 through 6 represent other examples of different designs available in the market. In some cases, abrupt changes in shaft diameter are used to produce flexure points that could be considered "hinge" points. The apparent attempt is to accelerate the club head to higher velocities. In other cases, it seems that the moment of inertia of the shaft has been deliberately increased.

Composite graphic golf club shafts are formed in a well known process from composite graphite sheets, of graphite fibers and resin, that are rolled up about a mandrel and heat treated to produce a finished shaft. The sheets are made from fibers packaged into strings that are compressed and extended in a rolling mill to form what is called "pre-preg." Graphite fibers come in different tensile strengths and tensile modulus values. The common expressions for differentiation are "standard," "high," and "ultra-high" modulus. We define tensile modulus (stiffness) as 103 KG/mm$^2$. Thus 24 modulus is 24×103 KG/mm$^2$ and is considered "standard." 36 modulus and 40 modulus are "high modulus"; and 46, 55 and 60 are "ultra-high" modulus. The general manufacture of sheet based shafts is well documented in literature and elsewhere (see, for example U.S. Pat. No. 4,319,750, issued Mar. 16, 1982, to Roy, and titled GOLF SHAFT HAVING CONTROLLED FLEX ZONE) and is not repeated here.

In considering moment of inertia of solid and hollow tubes (see FIGS. 8A and 8B, respectively), the first point is the property of a cross section of shaft. In a hollow tube (FIG. 8B), it is defined as, $I=\pi(D1^4-D2^4)/64$, D1 being the outside diameter (O.D.), and D2 being the inside diameter (I.D.). The difference between the two is called "wall" thickness; (D2–D1="wall thickness"). If wall thickness is held constant, while O.D. is increased, then I is increased. Or, if O.D. is maintained, while I.D. is decreased, then I is also increased. The moment of inertia of a solid cylinder (FIG. 8A) is, $I=\pi D4/64$. By contrasting the two, hollow versus solid, it becomes quite obvious why golf shafts are made as thin walled cylinders.

The moment of inertia of an entire club, (see FIG. 9) must also be considered. It is defined as the sum of all of the masses constituting the club multiplied by all their lengths, squared, as measured back to the axis of rotation ($I=\Sigma l_i^2 m_i$). "O.C." is the origin of coordinates, about which the golfer cocks his wrists (also see FIG. 10). This point of axis is variable, depending on the size of the player's hands and wrists. Observation has shown this to vary between 4 and 5 inches from the butt end of the grip. Any mass placed in the direction of the tip end of the shaft increases the moment of inertia by some parabolic value.

One finds most players operating close to the maximum force they can apply to the club as they play the game. It is reasoned, therefore, that an increase in "I" is undesirable, while a decrease is desirable. In prior art, it is seen that moment of inertia has been increased in many instances, or, as in the case of standard shafts, is not optimized.

In spite of the foregoing, a lower moment of inertia may benefit the player in three ways. He may (if his muscles are fast acting enough) be able to accelerate the club to higher impact velocities. Experimentation has shown this to be true for many players. If the player cannot take advantage of the reduction in "I" (his strength is adequate but the muscles are slow reactors), he will "feel" less strain as he swings the club. This leads to better, more controlled, play. The third benefit, for the player of adequate strength but slow muscles, is that weight can be added to the club head, in some amount that can be handled, to increase the effective mass at collision.

In addition, a longer arc, produced by a longer shaft, will produce a higher swing speed. It is evident that a lower moment of inertia will enhance the objective.

Flexure of the shaft can also be better optimized to better orient the head of the club to a squarer position, with the head loft at optimum, just prior to impact with the ball. For many years shaft stiffness (commonly called "flex") has been designated by the terms: extra stiff ("XS"); stiff ("S"); firm ("F"); regular ("R"); average ("A"); and ladies' ("L"). These designations are not precise. Indeed, measured stiffness frequently varies from manufacturer to manufacturer, although the same terms are given.

The usual method of measuring stiffness (flex) is by clamping the butt end of a shaft horizontally on a deflection board. A weight is then affixed to the tip (commonly 6 lbs.), and the shaft freely bends towards the ground (see FIG. 18). The less the deflection, the stiffer the shaft; and vice versa.

This method, butt clamping with load added to the tip, is thought to largely mimic the club bending during a swing.

Some manufacturers reverse the procedure by clamping the tip end and adding the weight to the butt end. This is thought to produce a more complete picture of the shaft flexural characteristics, when added to the usual evaluation.

For any section selected along the length of a shaft (see FIG. 8B), the modulus will be $\pi(D1^4-D2^4)/32D1$. Since common shafts are essentially cylinders tapering in a straight line from butt towards the tip (or in the case of steel shafts, containing small steps that behave as a straight line taper), it is obvious that any section selected towards the butt end will be stiffer than a section towards the tip end, if the wall thickness is constant, and the material is homogeneous.

When a club is held by the butt and swung, it has been observed that the energy of motion (kinetic energy) is fed outward, from the player's arms towards the club head (see FIG. 23). As the player's arms slow down, much of the kinetic energy is fed into the butt end, which is considerably less massive than the arms. As the butt end, in turn slows, much of the kinetic energy is transferred to successively smaller and smaller sections of the shaft, accelerating the tip. The action can be likened to that of a whip or a fishing fly rod. However, the control the golfer can exert on the tip and club head is evidently lacking, judging from high and low, and left and right, shots seen during a typical round of play.

Terms such as "bend point," "flex point," and "kick point" are frequently employed to describe another shaft characteristic. In the case of "bend point," the shaft is clamped in a device and mounted horizontally. Both butt and tip are firmly clasped. Then the shaft is compressed along its longitudinal axis such that the shaft bulges upwards. The point on the length of the shaft furthest from the horizontal is considered to be the "bend point." Many claim this is not the point of maximum flexure during the golf swing and is misleading. They use a deflection board, clamping the shaft at the butt end and affixing a weight to the tip end, as previously described. An imaginary straight line is then drawn, connecting the clamped butt end to the bend position of the loaded tip (see FIG. 18). The point on the shaft at maximum distance perpendicular to the imaginary straight line is considered to be the "kick point" or "flex point" (synonymous terms). Fast acting cameras tend to confirm this procedure as more correct.

Some have taken to specifically designing into the shaft a definite flex point. This has been done by laying a small piece of stiffer sheet material, such as boron, to the several layers, the exact method being proprietary to the manufacturers. A "hinge" or flex point is formed by virtue of the stiffness gradation of the dissimilar moduli of materials.

The shaft can be taken to be divided into two zones of flexure, a butt end pattern and a tip end pattern. Some manufacturers have then deliberately made the tip, or the butt, more flexible, or stiffer, than the common tapered shaft design would otherwise yield. These shafts are offered as "tip strong-butt weak" for players with high swing speeds; and "tip weak-butt strong" for those with slow swing speeds. This is done in recognition of the difficulty the slow swinger has in getting the ball airborne and achieving the desired launch angle. The high swing speed player, on the other hand, is found to have the power to over bend the tip and is offered a stiffer tip to combat this. All this is done in conjunction with a deliberate attempt to further aid the golfers by positioning the flex point at some point from the tip end that corresponds to their needs. Typically, the flex point is located as follows: stiff shaft, 42–44% of shaft length from the tip; regular shaft, 41–42% of shaft length from the tip; average shaft, 39–41% of shaft length from the tip.

Such efforts as the two zone flexure concept and the specific flex point locations concept are reasonable attempts to better fit the player. However, these concepts still leave considerable room for improvement in control.

Accordingly, it is a principal object of the present invention to provide a composite golf club shaft having a low moment of inertia, and concomitantly, reduced control difficulties found in conventionally constructed composite golf club shafts.

It is a further object of the invention to provide such a golf club shaft for use in any category of modulus.

It is another object of the invention to provide such a golf club shaft which permits the manufacture of longer golf clubs to more conform to the force limitations of the players.

It is an additional object of the invention to provide such a golf club shaft which better optimizes the flexure of the shaft to better orient the head of the club to a squarer position.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a shaft for a golf club, said shaft comprising: tip and butt ends defined at opposite distal ends of said shaft's length; and said shaft having a balance point axially spaced from said tip end a distance in the range of from about 56 percent to about 58.5 percent of said shaft's length. In another preferred embodiment, there is provided a composite shaft for a golf club, said shaft comprising: tip and butt ends defined at opposite distal ends of said shaft's length; said shaft being tubular and tapering generally from a larger diameter at said butt end to a smaller diameter at said tip end; said shaft being constructed primarily of a first material having a first modulus of elasticity; and two, spaced apart cylinders of a second, reinforcing material, having a second modulus of elasticity greater than said first modulus of elasticity, disposed axially in said first material, said cylinders being disposed either side of a point axially spaced from said tip end a distance in the range of from about 45 percent to about 52 percent of said shaft's length.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
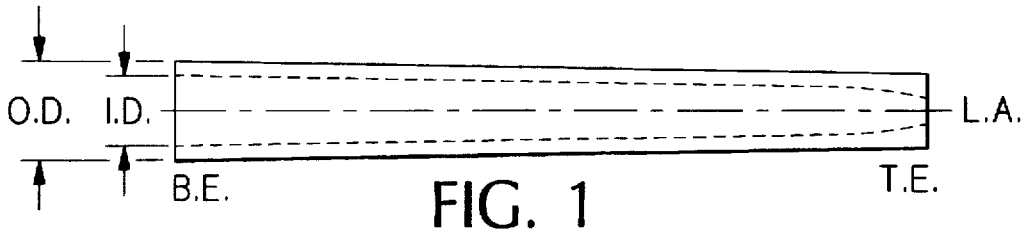
FIG. 1 (PRIOR ART)
FIG. 1 is a representation of the common or standard shaft most frequently in use. The "B.E." (butt-end) has a larger O.D. (outside diameter) and a larger I.D. (inside diameter) than the "T.E." (tip-end). It can be seen that the shaft tapers from the butt end towards the tip end. The tip O.D. is 0.370" for an iron and 0.335" for a wood. Butt O.D. will vary between 0.580" and 0.620" depending on the shaft flex, material, etc. The first several inches of the tip end are shown with a parallel O.D. (commonly called parallel tip). The dotted line indicating I.D. shows a build up of material in the tip end for added tensile strength in that region.
Figure 2:
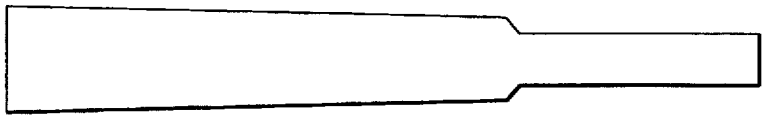
FIG. 2 (PRIOR ART)
FIG. 2 is an exaggerated sketch of a conventional shaft with a large change in O.D. at a point closer to the tip end, to form a step that will serve as a flex point.
Figure 3:
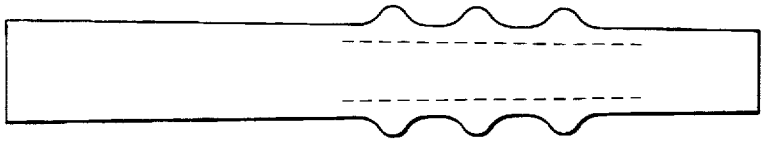
FIG. 3 (PRIOR ART)
FIG. 3 is an exaggerated view of a conventional shaft containing a buildup of material in three distinct locations to serve as three flex points.
Figure 4:
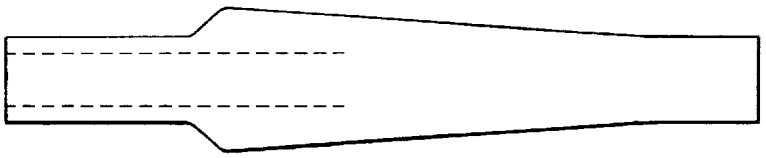
FIG. 4 (PRIOR ART)
FIG. 4 is an exaggerated view of a conventional shaft having a large build up of material towards the butt end, forming a distinct step.
Figure 5:
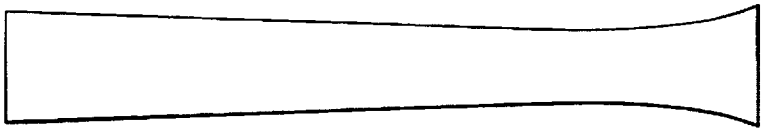
FIG. 5 (PRIOR ART)
FIG. 5 is an exaggerated view of a conventional shaft having a large O.D. increase in the tip end.
Figure 6:
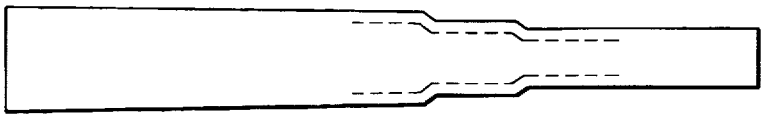
FIG. 6 (PRIOR ART)
FIG. 6 is an exaggerated view of a conventional shaft containing 2-steps that serve as flex points.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

It should be understood that the physiology of the golfing population is almost infinitely varied. Thus, no single design of a single modulus can be put forth to serve the all golfers. The present invention consists of a family of designs, with variations of specific details, but centered around core designs.

Rather than following the conventional two zone flexure concept or the specific flex point locations concept, this invention creates a different philosophy. The center portion of each category of shaft (i.e., stiff, firm, regular, etc.) has been stiffened relative to both the butt end and the tip end. The result of this stiffening can be seen on a deflection board in the manner shown in FIG. 18 where the bending profile of a conventional shaft 100 is compared with a shaft 102 constructed according to the present invention. It can be seen that the flex point of shaft 102 is farther from the tip end than that of shaft 100. The effect of the stiffening of the center portion of shaft 102 compared to that of shaft 100 is further illustrated in FIG. 19 where the comparative bending of the center portions only of the shafts (not on a deflection board) is shown with the ends of the center portions superposed.

The center portion of shaft 102 is further arranged through materials and geometry into definite points of flexure, as is described in detail below. The total effect, when shaft 102 is swung as part of a golf club, will be more akin to the curving action of the center of an archery bow than the whip (or fishing fly rod) action found in prior art (see FIG. 22). The orientation of the club head at impact, with regard to both the line of intended flight and the launch angle, are improved by this design.

Figures 21A, 21B, 21C:
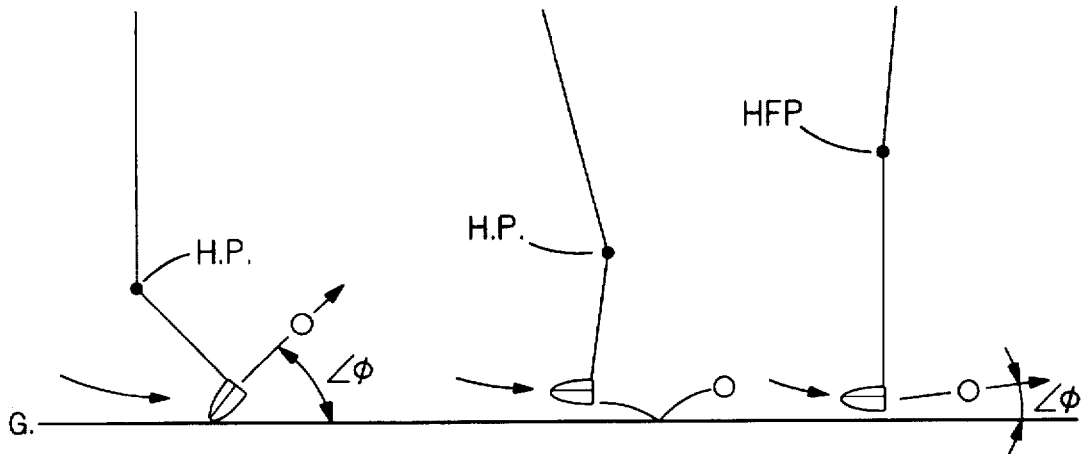
FIG. 21A is a front elevation view illustrating an excessive launch angle of the ball due to a flex point that either over-hinges or is in a location on the shaft that is too low. Overall, the shaft is also not stiff enough for the player.
FIG. 21B is a further view of the shaft of FIG. 21A, showing the head lagging behind when used by a powerful player, with a concomitant topping of the ball.
FIG. 21C is a front elevation view illustrating an excessively stiff shaft with a high flex point location which yields an excessively low launch angle of the ball.

Consonant with the objective of a lower moment of inertia, shaft 102 has its stiffened center portion perforce located further from the tip end than prior art. Such would ordinarily produce a low launch angle of the ball (see FIG. 21C). Accordingly, further geometric variations are therefore placed in key locations between the center portion of the shaft and the tip end, as is described in detail below. These geometric variations serve as further flex points and are embodied in a precise relation of shaft O.D.'s and I.D.'s to not only provide the proper launch angle (the loft angle designed into the given golf club head), but to accelerate the head to a higher impact velocity. The overall design increases the strain energy stored by the golf club which, when released during the time the ball and the club are in contact, works to propel the ball further.

In the foregoing examples of prior art golf club shafts (FIGS. 1–6), one can see definite cases where there is a mass build up due to varying wall thickness, away from the axis of rotation (O.C.) of the club and in the direction of the tip end. If the given shaft were placed on a fulcrum horizontally, a point of balance could be precisely located. Such balance points reveal the center of mass of the shafts, from which moment of inertia (I) can be calculated. When the balance point of a typical steel shaft "wood" is then measured to the tip, the distance is usually between 21 and 22 inches. For a steel shaft "iron", the balance point is generally between 18 and 19 inches measured to the tip. For the common, or standard, prior art composite-graphite shafts, the balance points tend to be slightly higher, varying between 22 and 23 inches to the tip in the case of "wood" shafts; and 19 to 20 inches, in the case of "iron" shafts. Some of the prior art graphite shafts exhibit lower values, especially those with large concentrations of mass between the mid point of the shaft and the tip.

The present invention sets the balance points, as measured from the tip, approximately as follows:

| Woods | Irons |
|---|---|
| 45" shaft, 25.2" ("S" flex) | 39" shaft, 22" ("S" flex) |
| 48" shaft - 28" ("S" flex) | 39" shaft - 22.8" ("A" flex) |
| 45" shaft - 26.2" ("A" flex) | |

Shafts of intermediate flexes have balance points in between the above extremes. In general, then, the balance point of a shaft constructed according to the present invention will have a balance point that is a distance from the tip of the shaft that is between about 56% and 58.5% of the length of the shaft. This applies to any modulus of material (low-, high-, or ultra-high) used for a given design. It is therefore evident that moment of inertia is reduced by a definite amount over prior art shafts by such design. To accomplish this, each design of any material's modulus and stiffness has a mass reduction (as compared to common or standard shafts) in the zone of length between approximately 14" and 22" from the tip for "wood" shafts; and between approximately 12" and 20" from the tip in the case of "iron" shafts (see FIG. 13). Ordinarily, this would leave the shaft vulnerable to breakage while in use due to the reductions of shaft section modulus. This is combated by adding small sections of higher modulus ply at judicious locations, with the plies so oriented that the tensile strength and the compression strength is increased. For example, on 36 modulus wood shaft designs, the shafts will withstand the following bending loads: "S" flex, 140 lbs./cm$^2$; "R" flex, 130 lbs./cm$^2$; "A" flex, 120 lbs./cm$^2$. Testing has shown these values to be high enough to withstand worst case conditions, such as a poorly executed swing where the ball is struck high on the face of the club in the heel area, which maximizes head movement during impact, thus stressing the shaft. The precise amounts and locations of added material for a given bending load can be easily determined by those skilled in the art.

Figure 18:
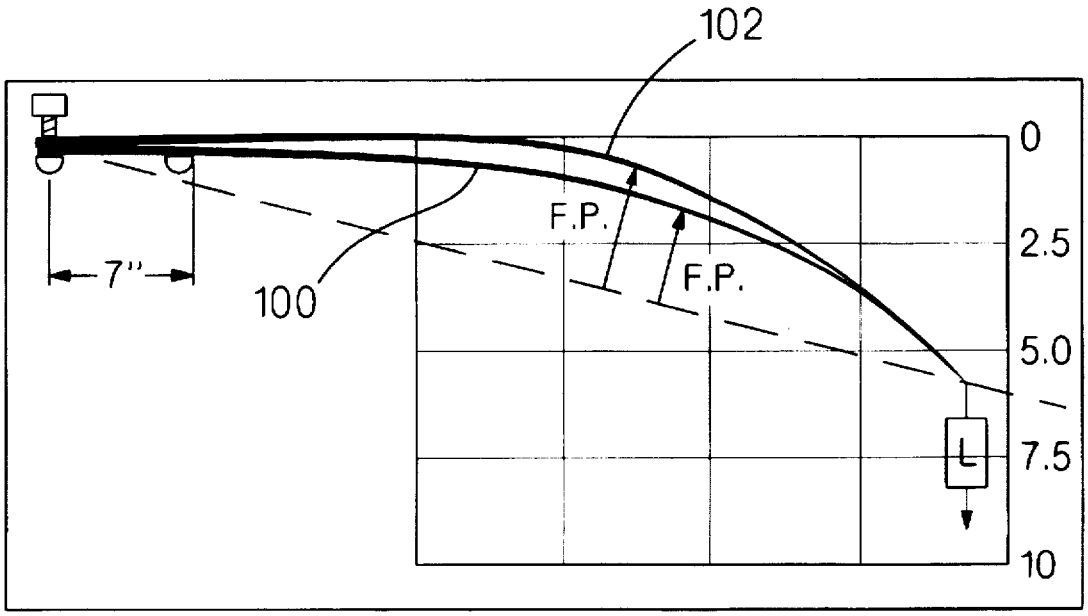
FIG. 18 is a diagrammatic view of a deflection board with the shaft of the present invention superimposed over a shaft of prior art, indicating the differences in bending while under a known load.
Figure 19:
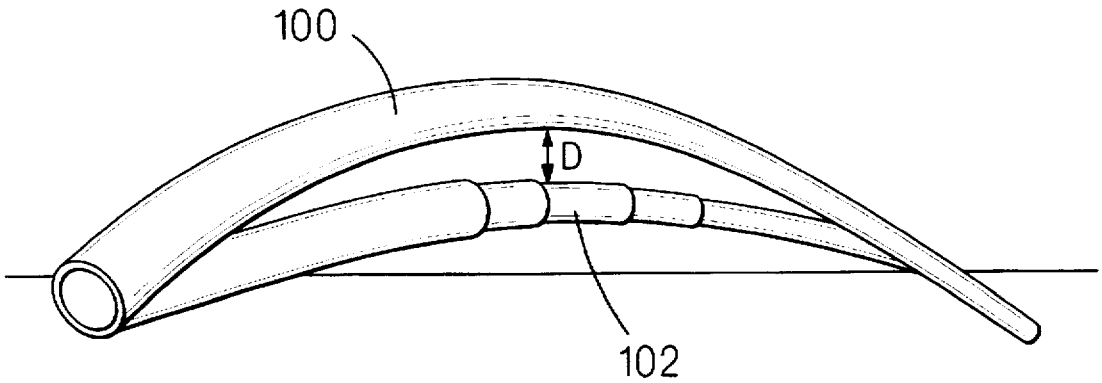
FIG. 19 is an exaggerated, fragmentary view of the center portions of the shafts shown in FIG. 18.

As was seen in FIG. 18, the center portion of shaft 102, constructed according to the present invention, is stiffer as compared to a conventional shaft 100. The center portion of shaft 102 is also necessarily stiffer in relation to both its own butt end and tip end, when compared with prior art. The lower moment of inertia goals of the present invention prevent attaining such stiffness by simply increasing shaft diameters in that center area. Further, while the several moduli available in graphite may have relatively high stiffness values, their relative compression strength is low. Indeed, high modulus graphite tends to be somewhat brittle as compared to standard modulus graphite, due to compression strengths that are much lower than the value of standard modulus. From a chart of one of the fiber manufacturer's (Toho Rayon Co., Ltd., Japan), the following metric values are given:

| Tensile Modulus | Tensile Strength |
|---|---|
| 24 - (103 KG/mm$^2$) | 400 (KG/mm$^2$) |
| 36 - (103 KG/mm$^2$) | 300 (KG/mm$^2$) |
| **Tensile Modulus** | **Compression Strength** |
| 24 - (103 KG/mm$^2$) | 570 (103 psi) |
| 36 - (103 KG/mm$^2$) | 415 (103 psi) |

Figure 17:
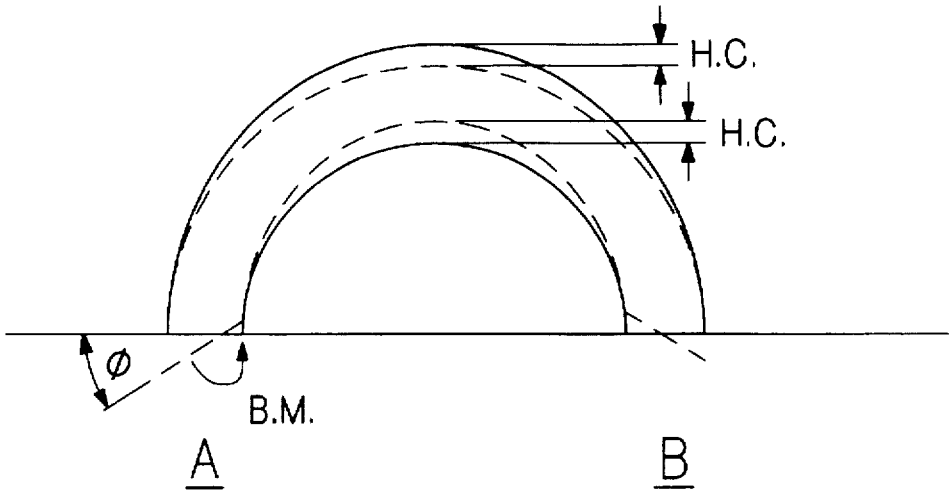
FIG. 17 is a plan view of a length section of any thin walled pipe or tube, representing the compression and tension that occurs when the section is bent by a force. The section is firmly anchored at point B, subjected to a bending moment B.M. at point A. Angle $\phi$ represents the distortion to the pipe that may occur. H.C. represents the hoop compression that may take place as a result of the loading.

These values force dedicated individual designs for each modulus type employed. However, no modulus, or combination of several, has been found that would yield the relative stiffness needed without forming the hoop compression illustrated in FIG. 17. (Also, see J.P. Den Hartog—"Advanced Strength of Materials".) High- and ultra-high modulus plies also fail to achieve the desired bending strength targets of the present invention, due to their low tensile strength.

Boron fiber is the preferred additive material to properly stiffen the center section of the several designs of the present invention. A leading supplier of boron fiber for such purposes (Textron Corp., USA) cites the following characteristics:

| | |
|---|---|
| Tensile strength | 520 ksi (3600 MPa) |
| Modulus | 58 × 106 psi (400 GPa) |
| Compression Strength | 1,000 ksi (6,900 MPa) |
| Density | 2.57 g/cm$^3$ |

It can readily be seen that boron provides the mechanical properties not found in graphite alone.

Figure 14:
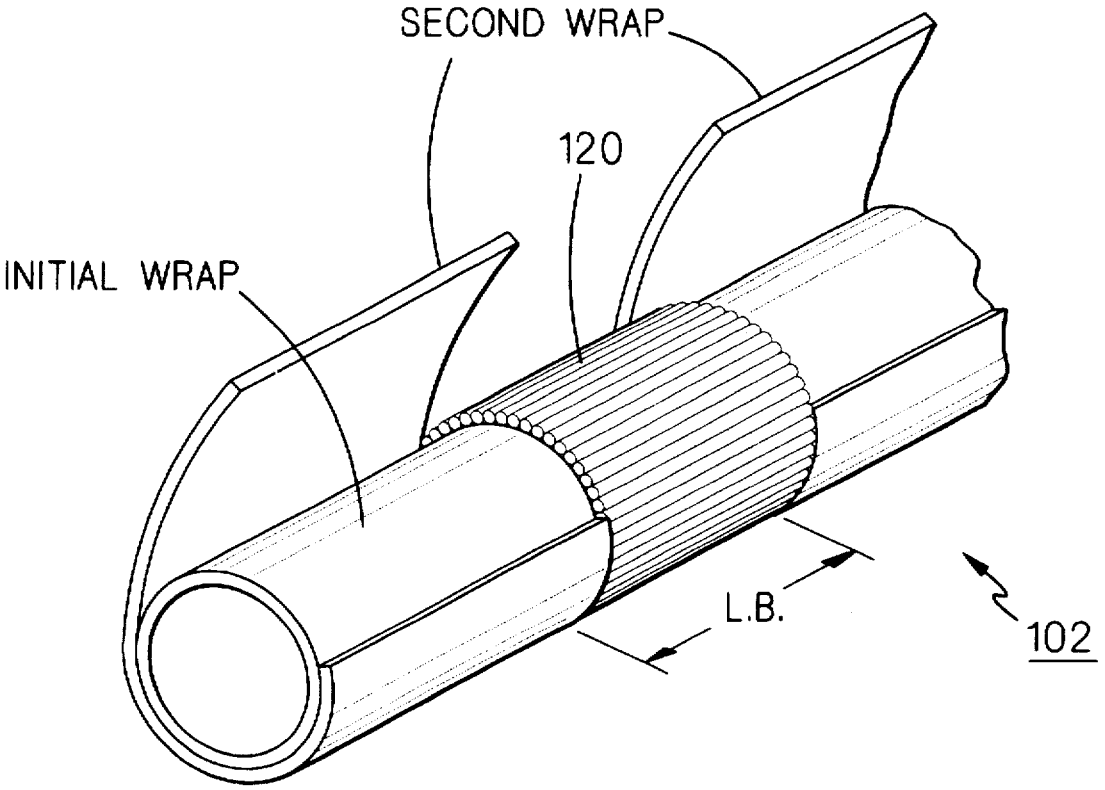
FIG. 14 is a cutaway view of a small length of shaft, corresponding to the boron ring locations in FIG. 12. In this instance, the boron ring "B" is in the inner second wrap of the sheets forming the shaft and has an axial length L.D.
Figure 15:
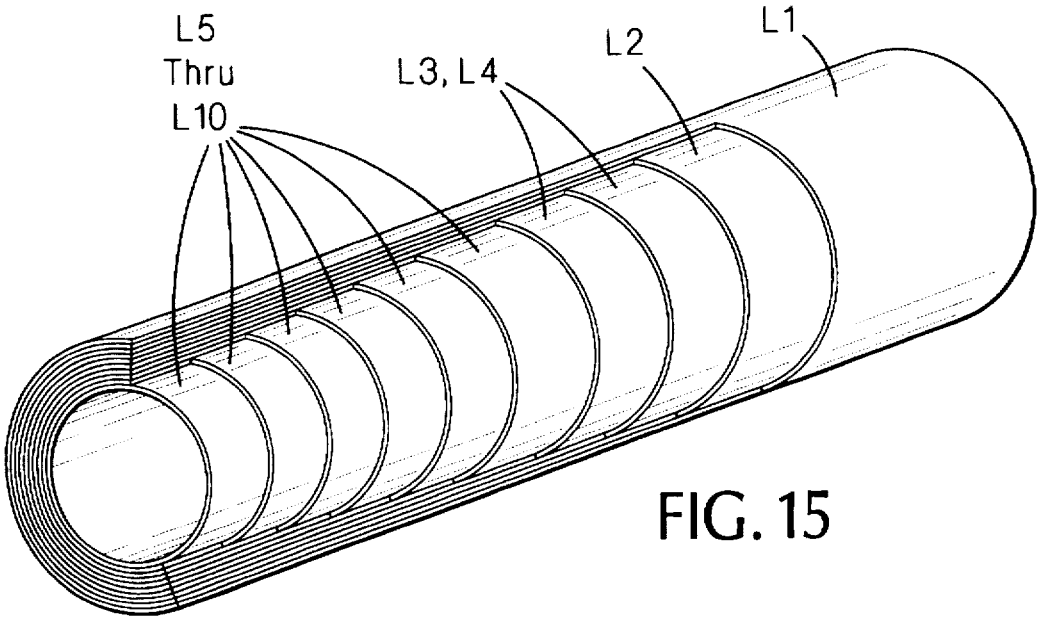
FIG. 15 is a view of a common sheet rolled shaft, showing ten (10) layers, comprising the tip end. L6 through 10 might typically be of higher modulus material. L5 is a typical boron layer. L4, L3, and L2 represent lower modulus layers. L1 represents paint and lacquer.
Figure 16A:
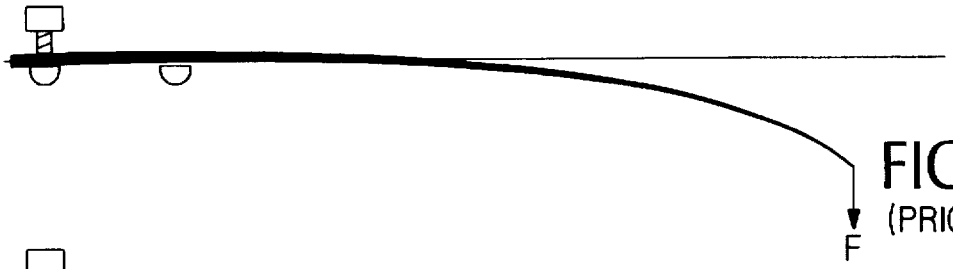
FIG. 16A (PRIOR ART)
FIGS. 16A, 16B, and 16C represent three different prior art shafts, firmly attached to a conventional deflection board at the butt end, and having a load affixed to the tip end. The bending of the shafts as a result of the load is shown in typical form.
Figure 16B:
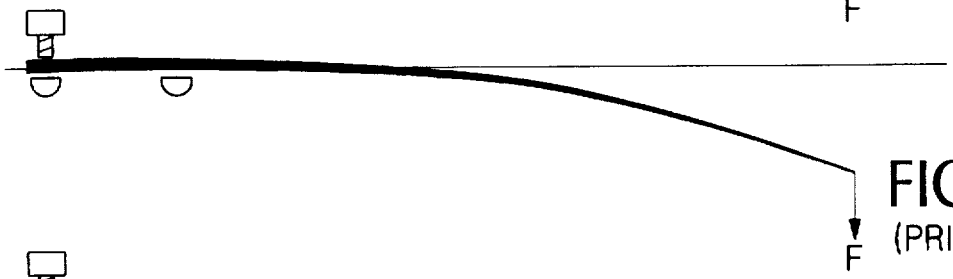
FIG. 16B (PRIOR ART)
Figure 16C:
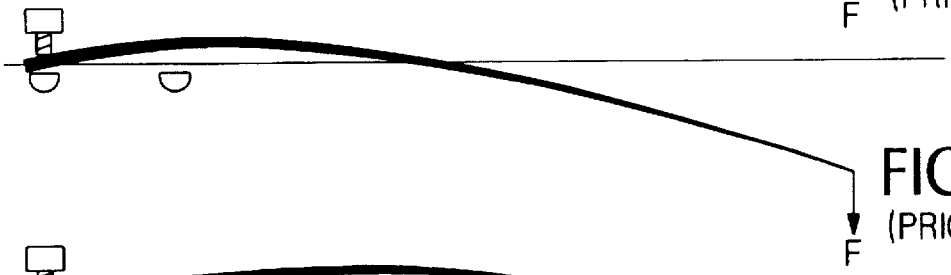
FIG. 16C (PRIOR ART)
Figure 16D:
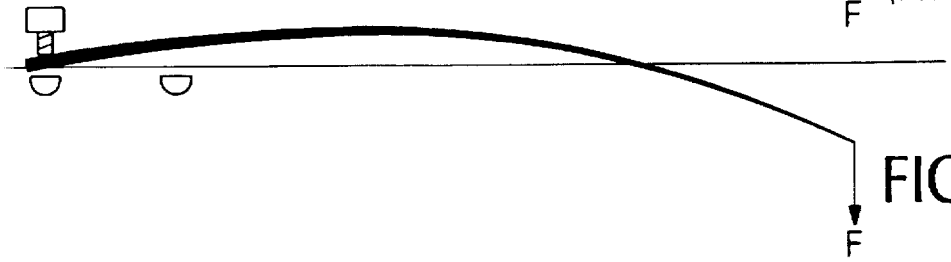
FIG. 16D shows a golf club shaft, constructed according to the present invention, mounted on a deflection board and represents the contrast of bending to prior art shafts (FIGS. 16A–C) in a somewhat exaggerated form.

FIG. 14 shows a typical section 120 of commercially available boron fibers laid into the wraps of graphite prepreg to form a cylinder, with a boron layer thickness of 5.6 mil. For most designs, it is found that the best location for the boron is as an integral part of the first inner wrap of graphite sheet. In low modulus designs, placing the boron in the second wrap, as shown in FIG. 14, yields better performance.

Figure 12:
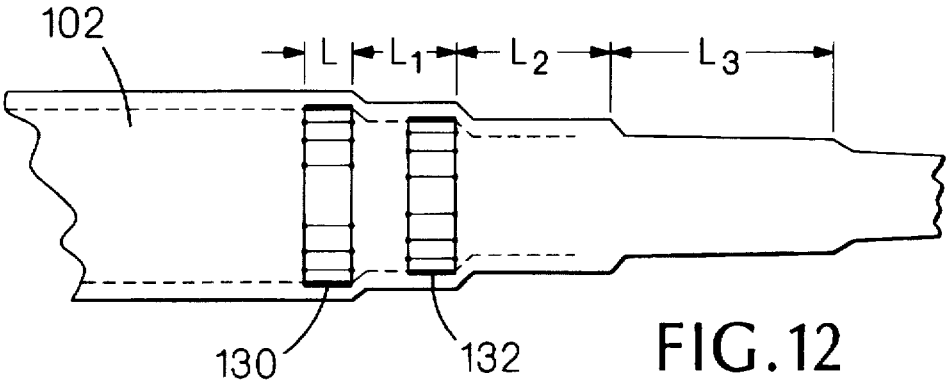
FIG. 12 is a fragmentary, plan view of the shaft of FIG. 11, enlarging the four steps of FIG. 11. Elements 130 and 132 represent two boron rings. L1, L2 and L3 show the positions of the steps with respect to one another.

According to one embodiment of the present invention, more optimum performance is achieved by employing two distinct boron cylinders 130 and 132, spaced fairly close together in a four-step shaft 102, as is indicated in FIG. 12. The length of each boron cylinder, L.D., cannot be less than about 10 mms or more than about 13 mms. The axial separation between the ends of each cylinder cannot be less than about 25 mms or more than about 33 mms. Such small variations in lengths are necessary to accommodate the several moduli of graphite that can be employed for the several designs that are possible. Two distinct boron cylinders, spaced close together, showed no detectable increase in hoop compression, as compared to a single long cylinder. The separation created a definite flex point in between the two boron cylinders that tended to restore the proper launch angle of the ball, more corresponding with the loft of the club head. To further optimize the design, step S1 is desirable for both moment of inertia considerations and for enhancing the hinging action in the flexure area formed between the boron sections. The height of step S1 above the O.D. of step S2 ("H" of FIG. 13) must be small, not exceeding about 0.012 inches, for the relative stiffness needed in the central area. On high modulus designs, the test players achieved a 3 M.P.H. increase in club head impact speed, at an average, by virtue of the step. For stiff shafts, a second identical boron cylinder of 5.6 mils, tightly girding the boron cylinder 132 of FIG. 12 is employed for purposes of adding to the relative stiffness. On low modulus designs, where the mass of material is inherently greater, the second boron cylinder at 132 is employed, in like fashion, for all stiffness classifications, "S," "R," "A," etc.

Figure 13:
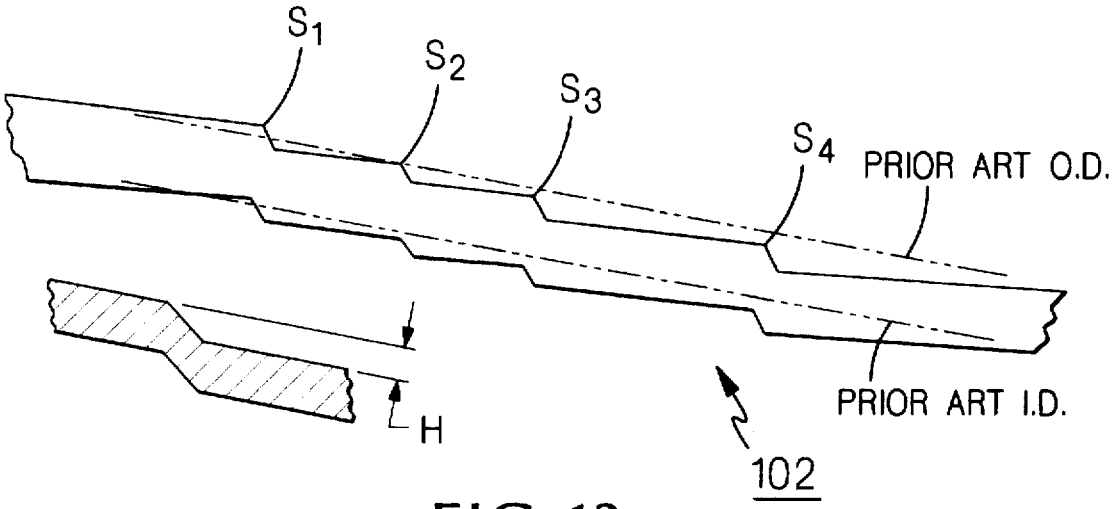
FIG. 13 is an exaggerated cross-sectional view of the wall of the shaft of FIG. 11 showing the comparison of O.D. and I.D. with respect to a common or standard shaft (broken lines) in the region formed by steps S1, S2, S3, and S4.

The steps formed at S2, S3 and S4 have variations in O.D. to achieve several objectives. The first objective is to reduce the mass in the zone from the center of the shaft towards its tip, (L, L1, L2 and L3), which in turn reduces moment of inertia. As can be seen in FIG. 13, portions of the steps are perpendicularly further from the axis of the shaft, while the larger portions are somewhat closer to the axis of the shaft, as compared to a common or standard shaft. The net effect is to reduce the relative stiffness of the tip area, as compared to the center area. This reduction now allows the tip to bend to the same end point on a deflection board that corresponds to the tip of a common or standard shaft end point, as shown in FIG. 18. This relative reduction in stiffness is necessary to have the club head meet the ball at its designed loft angle. If the club head is oriented to its designed loft at impact, it must also be automatically square to the intended line of flight of the ball. The relative reduction in tip zone stiffness necessarily increases the velocity of the club head at impact, when coupled with the increased stiffness of the center zone, due to the "bow"-like action that occurs when the club is swung.

Figure 23:
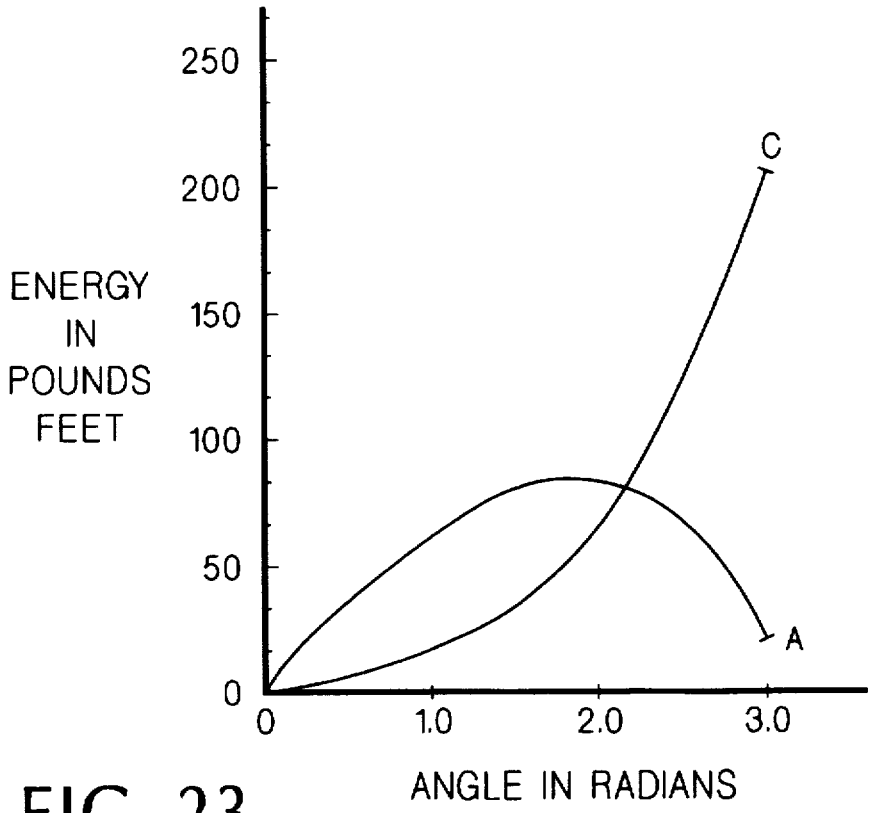
FIG. 23 is a chart illustrating the kinetic energies typical to a driver swung to a collision velocity of 100 MPH. Curve A represents the variation of the player's arms. Curve C represents the variation at the club.
Figure 24:
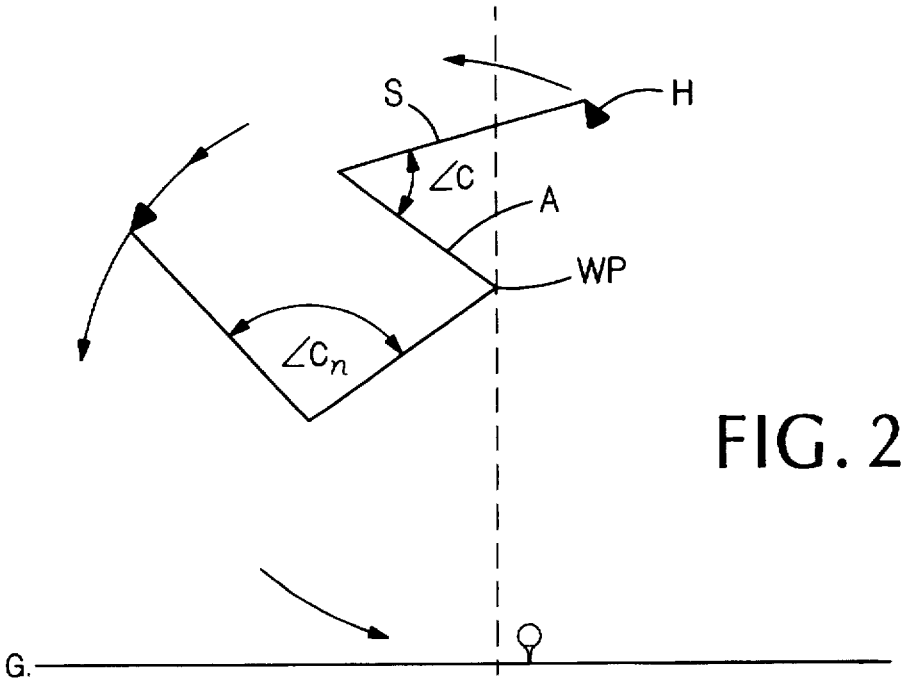
FIG. 24 is a front elevation representation of a player swinging a club from zero velocity at the top of the backswing to some eventual collision velocity. WP is the axis of rotation. With further refinement, this can be made into a vector diagram to calculate the velocities of both the arms and the club, from which the total kinetic energies of the system can be estimated.

As the club is swung, kinetic energy is fed from the player's arms towards the head. (See FIG. 23) In the process, bending strain occurs at the zones of relatively high stiffness. As the portions towards the butt slow, the strain is relieved as the kinetic energy is fed into successively smaller sections of shaft. Some of the energy must be lost to internal friction, of course. However, it has been commonly observed that the tip is eventually accelerated by some finite amount on whatever common shaft being employed. In this invention, this fly rod or whip action is harnessed by greater contrasts of relative stiffness en route to the tip through the use of steps S2, S3, and S4. That is, the variations in section diameters intrinsically produce variations in modulus. This is additive to the stiff center zone and less stiff tip zone concept outlined above, and achieves additional tip end acceleration. The steps happen to form flex points that also aid tip acceleration. The steps are, as well, positioned and dimensioned as vernier adjusters to orient the club head to its designed loft at impact.

The relative positions of each step location must be very precise. The height of each step location, H, perpendicular to the shaft axis, must also be very precise.

The following lists the preferable "L" dimensions to be employed as regards to wood or iron shafts of any tensile modulus or shaft flex ("S," "R," "A," etc.):

L1: 40 mm's (+/−2)
L2: 60 mm's (+/−2)
L3: 100 mm's (+/−5)

Figure 22:
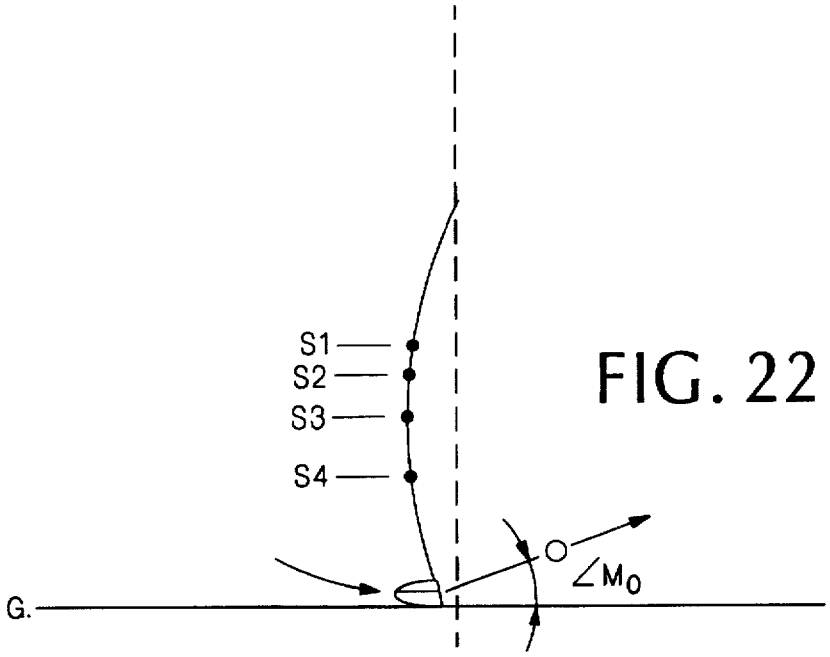
FIG. 22 is a front elevation view of a golf club with a shaft according to the present invention, illustrating the manner of flexure throughout the shaft at the time of impact with the ball, with the launch angle of the ball corresponding to the loft of the club.

The value of H is smallest at Step 1 and progresses to higher and higher values through Step 4. The flexure at each step therefore increases progressively from the center towards the tip and correspondingly serves to accelerate the club head to higher impact velocity, as shown in FIG. 22.

The locations of the four steps are, therefore, spaced at fixed separations from each other, irrespective of classification by flex or modulus. However, the entire group of four steps is shifted further from the tip, or closer to the tip, varying with the flex designation, as follows:

As measured from Step S1:
Stiff: 49–51% of shaft length
Regular: 47–48% of shaft length
Average: 46–47% of shaft length As previously mentioned, S1 locations are considerably farther from the tip than prior art of standard 45" and 39" shaft lengths. With regard to very long wood shafts, it was found that the relative position of S1 must be slightly closer to the tip:

Stiff: 46–48%
Regular: 45–47%

Figure 11:
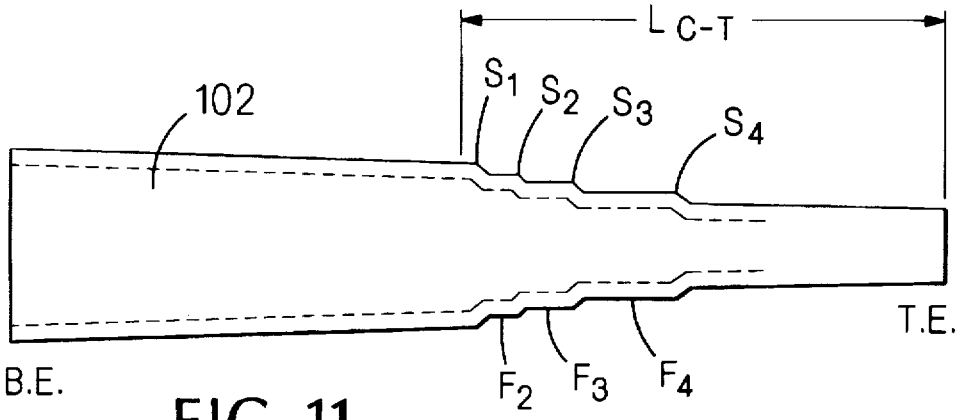
FIG. 11 is a plan view of a shaft constructed according to the present invention, showing four steps—S1, S2, S3, and S4—in a typical arrangement. The dotted line represents the I.D. forming a fairly uniform wall section throughout the step areas.

The wall thicknesses in the zones of Steps 1 through 4 are held as essentially constant, in any given design. The absolute values of O.D.'s, I.D.'s, and thus wall thicknesses, will vary greatly, since a unique pattern is required for each degree of flex, i.e., "XS," "S," "F," "R," "A," "L"; and for each end use, i.e., "woods", "irons", long drivers. The flat portions of the step areas, shown in FIG. 11 as F2, F3 and F4, are not quite parallel to the axis of the shaft, but slope from the butt end towards the tip end by 2.50°. Since the I.D. is fixed by a constant wall thickness, it is parallel to the O.D., and also slopes by 2.50° from the butt end towards the tip end. This small slope is necessary to easily remove the mandrel at the latter stages of fabrication. However, each dedicated design employing a given flex rating, and a particular modulus of material, will have its own unique wall thickness that must be set to conform to the section modulus and moment of inertia considerations of the overall concept.

By way of example only, and not intended as a limitation on the present invention, shaft 102 constructed from modulus 36 material could have a wall thickness of 0.052 inch, as might a prior art shaft similar to that shown in FIG. 1. Such a prior art shaft would have an O.D. of approximately 0.420 inch at a point 15 inches from the tip end and an O.D. of approximately 0.460 inch at a point 19 inches from the tip end, assuming a shaft with an "R" flex rating. These locations correspond to S4 and S3 on shaft 102 in FIG. 11.

Continuing the example, step S4 of shaft 102 (FIG. 11) forms two O.D.'s—one toward the tip end and the other toward the butt end. The former would be 0.385 inch, while the latter would be 0.410 inch. Both O.D.'s are less than the 0.420 inch cited above. With a constant 0.052-inch wall thickness, the I.D.'s are correspondingly less. The value of "H" for step S4 is, therefore, 0.025 inch. Step S3 of the present design corresponds with the location 19 inches from the tip end. Here, the O.D. of the tip side would be 0.420 inch, while the butt side of the step would have an O.D. of 0.440 inch. The value of "H" at S3 is, therefore, 0.020 inch. Moving 2.36 inches farther from the tip end, we reach step S2. Prior art would have an O.D. of approximately 0.484 inch. For this example, the tip side of S2 would have an O.D. of 0.470 inch and the butt side O.D. would be 0.485 inch, with a value of "H" of 0.015 inch. Moving another 1.57 inch from the tip, we reach step S1. Prior art would have an O.D. of approximately 0.500 inch at this point. For the example, the tip side of S1 would have an O.D. of 0.505 inch and the butt side would have an O.D. of 0.515 inch, with a value of "H" at 0.010 inch.

In the example, at S1 and S2, the constant wall thickness of 0.052 inch of the prior art is retained. From this, it is apparent that mass is less (thus moment of inertia is lower) in the tip side of the shaft, while the center of the shaft, when coupled with rings 130 and 132 (FIG. 12) and the unique geometry, is stiffer.

Figure 7:
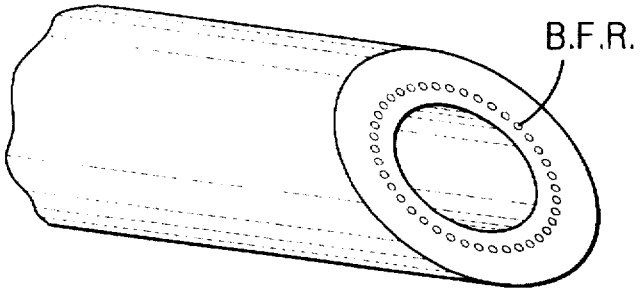
FIG. 7 is a section of a standard shaft tip showing a typical addition of a ring of boron to add tensile strength to guard against breakage.
Figure 8A:
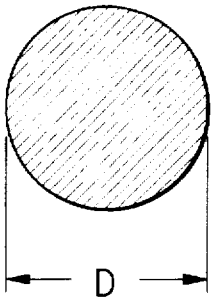
FIG. 8A represents the cross section of a cylinder that is completely solid and homogeneous.
Figure 8B:
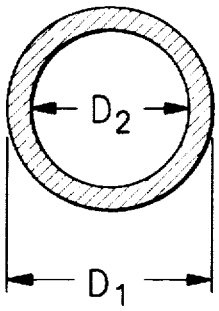
FIG. 8B represents the cross section of a thin walled tube or pipe, and is analogous to a cross section of a golf shaft at any given point along its length.
Figure 9:
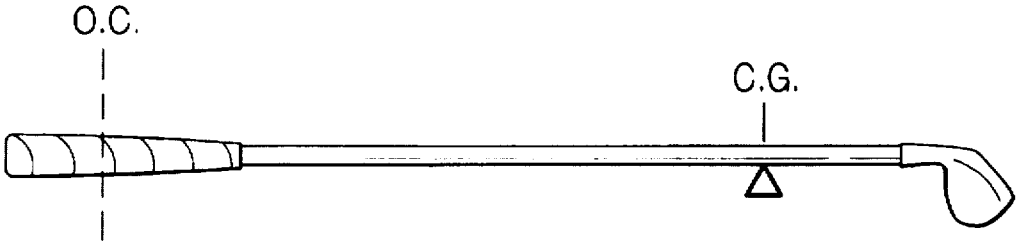
FIG. 9 represents any given golf club, wood or iron, showing an origin of coordinates (O.C.) at a point at the grip end about which the golfer cocks his wrists; and a center of gravity (C.G.) towards the head end of the club upon which the club would balance when placed horizontal to the ground.
Figure 10:
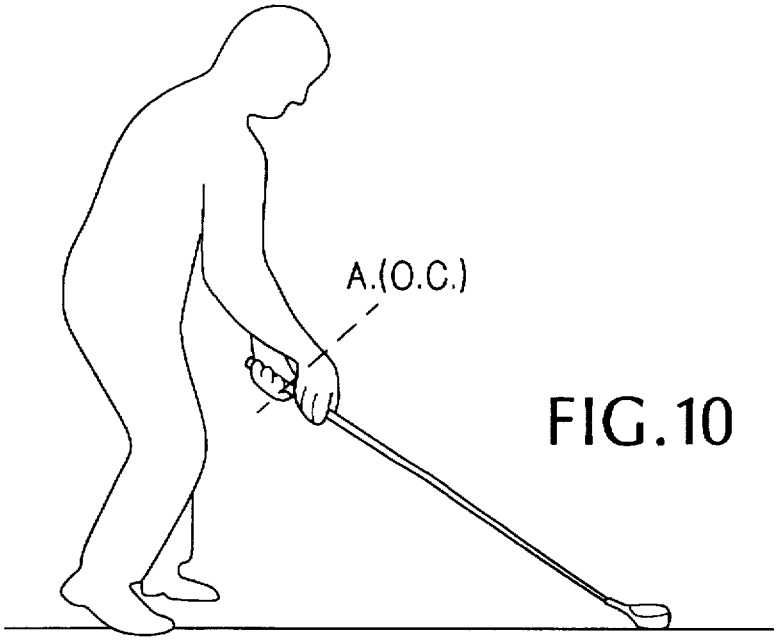
FIG. 10 shows a golfer in the process of a swing and indicates an axis—"A", corresponding to O.C. of FIG. 9, about which the rotation of the club is made.

In general, the high- and ultra-high modulus designs require tip reinforcing by a ring of boron (see FIG. 7) added to the tip area, about 6–7 inches long and running axially to about 7 inches from the tip, to add tensile strength. On 36 modulus wood designs, for example, the criteria to withstand impact forces at the tip are: for Stiff, 165 KG/cm$^3$; for Regular, 150 KG/cm$^3$; for Average, 140 KG/cm$^3$. For 48- and 50-inch very long shafts, the minimum is 175 KG/cm$^3$. These prove as adequate values for the worst case conditions found in off center hits of poorly executed swings. For low modulus designs, a boron ring in the tip (FIG. 7) is unnecessary to achieve adequate tensile strength.

Figure 20:
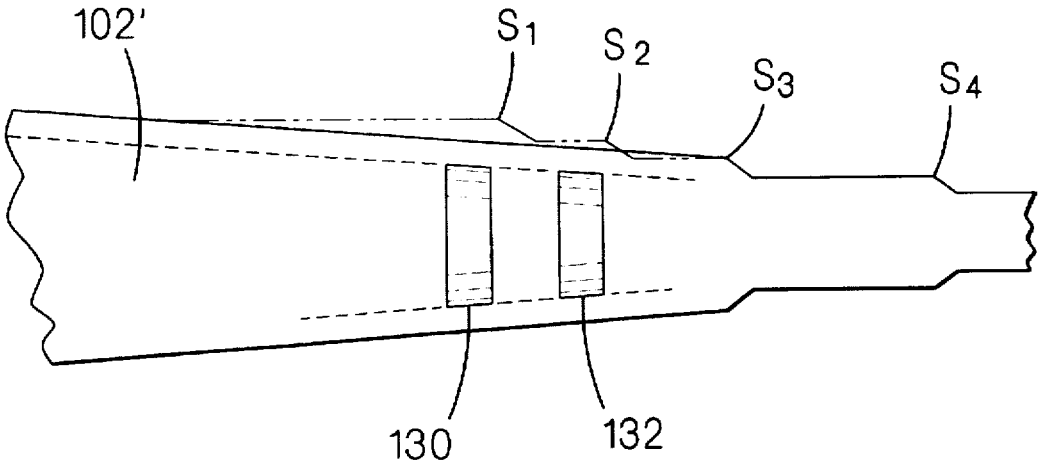
FIG. 20 is a fragmentary, plan view of a shaft constructed according to the present invention, showing an alternate design to FIG. 12 at steps S1 and S2. The steps S1 and S2 are removed, with their function carried by boron rings 130 and 132.

FIG. 20 illustrates a golf club shaft 102' constructed according to an alternate embodiment of the present invention for use in high- and ultra-high modulus designs, which design eliminates Steps S1 and S2. The function of Steps 1 and 2 are carried by the two boron cylinders 130 and 132. The hoop compression, while less than prior art, is nonetheless detectable. The locations of cylinders 130 and 132 are identical to the above. The center of mass of these designs is 0.4 inches further from the tip than the base designs, which yields a slightly lower moment of inertia. The axial length of the boron cylinders, L.D., must be at the upper end of the range, between about 12 and 13 mms for stiffness purposes. The separation of 130 and 132 is unchanged.

While the low modulus shafts are too resistant to bending by the elimination of the two steps (S1 and S2), the design proves to be a reasonably adequate substitute for the base design when employed with higher modulus graphite. Some one-third of the test players were able to utilize the lower moment of inertia and achieved higher impact velocities, ranging from 1 to 4 M.P.H. more. Some one-third could not distinguish a difference between the base design and this alternate. The last third achieved higher impact velocities using the base design, shaft 102 (FIG. 12), ranging between 1 and 4 M.P.H. more than the alternate design, shaft 102'.

A discernible cost benefit is realized, however, using shaft 102'. The sanding process at final preparation of a shaft in readiness for painting and lacquering is very delicate at the junctures formed at the steps. Time is lost in the care needed to properly sand the junctures, especially at S1, where the effective height, H, is small. Mistakes leading to oversanding and nicking can potentially increase the reject rate. Overall, the design of shaft 102' is considered a worthy, though not precisely identical, option to the basic design of shaft 102.

Very long drivers prove to be impractical using low modulus material. The overall static weight is too high for all but the most athletic of players to accelerate, as one might expect. The alternate design of FIG. 20 proves to be particularly effective for 46", 48", and 50" clubs, due to its lower moment of inertia. It is considered as the preferred design for such applications.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A composite shaft for a "wood" or "iron" golf club, said shaft comprising:

(a) tip and butt ends defined at opposite distal ends of said shaft's length;

(b) said shaft being tubular and tapering generally from a larger diameter at said butt end to a smaller diameter at said tip end;

(c) said shaft being constructed primarily of a first material having a first modulus of elasticity; and (d) two, spaced apart substantially cylindrical portions of a second, reinforcing material, having a second modulus of elasticity greater than said first modulus of elasticity, disposed axially in said first material, said substantially cylindrical portions being disposed to either side of a point axially spaced from said tip end a distance in the range of from about 45 percent to about 52 percent of said shaft's length.

2. A composite shaft for a "wood" or "iron" golf club, as defined in claim 1, wherein:

(a) each of said two substantially cylindrical portions has a length on the order of from about 10 to about 13 millimeters; and (b) said two substantially cylindrical portions are axially spaced apart a distance of from about 25 to about 33 millimeters.

3. A composite shaft for a "wood" or "iron" golf club, as defined in claim 1, wherein:

(a) said shaft has defined therein a plurality of steps in diameter, said steps progressively decreasing in diameter from toward said butt end to toward said tip end; and (b) a first step closest said butt end coincides with said point spaced from said tip end.

4. A composite shaft for a "wood" or "iron" golf club, as defined in claim 3, wherein:

(a) said shaft has first, second, third, and fourth steps;

(b) said first and said second steps are axially spaced apart a distance on the order of about 40 millimeters;

(c) said second and said third steps are axially spaced apart a distance on the order of about 60 millimeters; and (d) said third and said fourth steps are axially spaced apart a distance on the order of about 100 millimeters.

5. A composite shaft for a "wood" or "iron" golf club, as defined in claim 3, wherein: said first step represents a change in diameter of said shaft no greater than about 0.024 inch.

6. A composite shaft for a "wood" or "iron" golf club, as defined in claim 1, further comprising: a third substantially cylindrical portion of said second material disposed axially near said tip end.

7. A composite shaft for a "wood" or "iron" golf club, as defined in claim 6, wherein: said third cylinder has a length on the order of between about six and about seven inches and extends to within about seven inches of said tip end.

* * * * *